US007140754B2

(12) United States Patent
Thuma et al.

(10) Patent No.: US 7,140,754 B2
(45) Date of Patent: Nov. 28, 2006

(54) TRANSFORMABLE FLASHLIGHT APPARATUS

(75) Inventors: Michael Thuma, LaGrange, IL (US); Paul Mann, Oak Park, IL (US)

(73) Assignee: NTM Industries, LLC, LaGrange, IL (US)

( * ) Notice: Subject to any disclaimer, the term of this patent is extended or adjusted under 35 U.S.C. 154(b) by 0 days.

(21) Appl. No.: 10/773,957

(22) Filed: Feb. 5, 2004

(65) Prior Publication Data

US 2005/0174759 A1 Aug. 11, 2005

(51) Int. Cl.
*F21V 21/00* (2006.01)

(52) U.S. Cl. ..... 362/371; 362/191; 362/208; 362/253; 362/418; 362/421

(58) Field of Classification Search ..... 362/116, 362/157, 184, 191, 202, 208, 253, 371, 418, 362/421
See application file for complete search history.

(56) References Cited

U.S. PATENT DOCUMENTS 6,004,004 A * 12/1999 Altman et al. ..... 362/191
2003/0067772 A1* 4/2003 Coleman et al. ..... 362/202

* cited by examiner

*Primary Examiner*—Stephen Husar
*Assistant Examiner*—Meghan K. Dunwiddie

(57) ABSTRACT

A transformable flashlight apparatus includes a body member, a head member with a light-emitting device, and a connecting member for connecting the head member to the body member and allowing the re-positioning of the head member with respect to the body member. Attaching structure connects an attachable and moveable object to one or both of the body member and the head member of the flashlight.

3 Claims, 4 Drawing Sheets

16a
17
18
16b 6
16
6
12
13
O
14a
7
11
14
7
14a

14
B
15
14b

O
11

FIG. 9
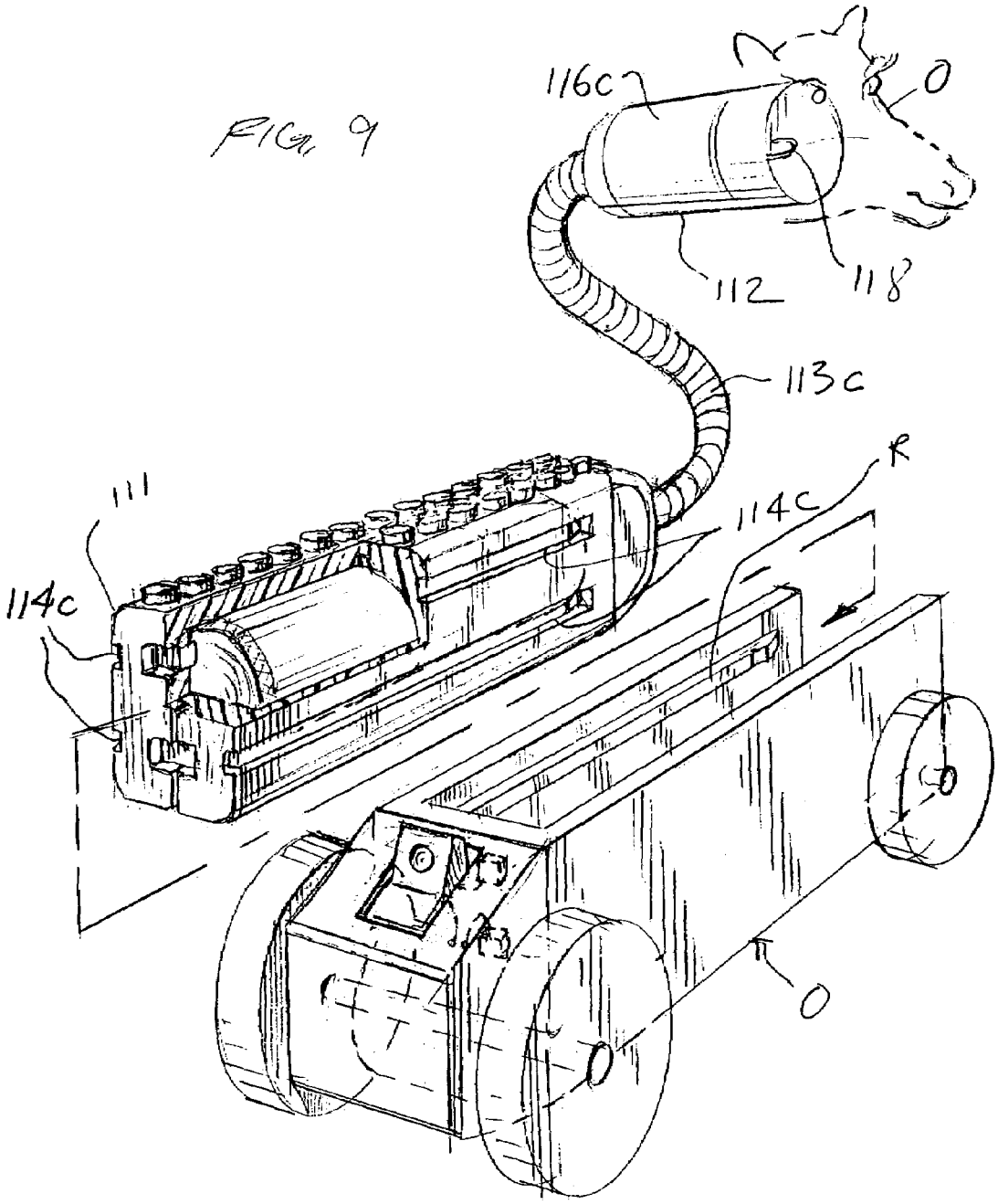
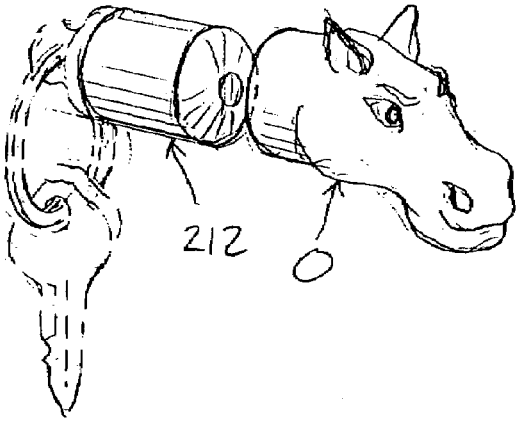
FIG. 10

TRANSFORMABLE FLASHLIGHT APPARATUS

BACKGROUND OF THE INVENTION

1. Field of the Invention

The present invention relates to a transformable flashlight apparatus, and more particularly to a flashlight apparatus that combines the function and play value of a small, multipositionable flashlight with the function and play value of custom designed decorative parts that attach to the flashlight and transform it to other configurations.

2. Description of the Prior Art

Conventional flashlights in the market today and those previously proposed have limited functions. Most of those flashlights are simply handheld light sources. They include a housing, batteries disposed in the housing and a bulb. Some provide the additional feature of a clip mechanism which allows attachment of the flashlight to a variety of supporting structures. Others include a power pack with one or more batteries, a light head and a flexible neck connecting the power pack to the head. One specific example of such a flashlight is the Black & Decker SNAKELIGHT® flashlight.

Unlike the conventional flashlights, the flashlight apparatus of the present invention provides a variety of functions. This unique and beneficial construction substantially increases the function and play value of a flashlight. It includes a multi-positional flashlight which received one or more decorative parts, allowing someone to change the configuration of the flashlight and create various objects. It serves as a flashlight as well as a transformable, interactive toy that allows the exercise of imagination and creativity.

SUMMARY OF THE INVENTION

In accordance with the present invention, a transformable flashlight apparatus includes a body member, a head member with a light-emitting device, and a connecting member for connecting the head member to the body member. The connecting member allows the repositioning of the head member with respect to the body member. Attaching means connects an attachable and moveable object to one or both of the body member and the head member of the flashlight, thus, changing the configuration of the flashlight.

BRIEF DESCRIPTION OF THE DRAWINGS

For a more complete understanding of this invention, one should now refer to the embodiments illustrated in greater detail in the accompanying drawings and described below as examples of the invention. In the drawings:

FIG. 9 is a perspective view of a second embodiment of the transformable flashlight of the present invention;

FIG. 10 is a perspective view of a third embodiment of the transformable flashlight of the present invention;

While the following disclosure describes the invention in connection with a number of embodiments, one should understand that the invention is not limited to those embodiments. Furthermore, one should understand that the drawings are not to scale and that graphic symbols, diagrammatic representations, and fragmentary views, in part, may illustrate the embodiments. In certain instances, the disclosure may not include details which are not necessary for an understanding of the present invention.

DETAILED DESCRIPTION OF THE DRAWINGS

Turning now to the drawings and referring specifically to FIGS. 1–4, the transformable flashlight apparatus 10 of the present invention generally includes a body member 11, a head member 12 and a connecting member or neck 13 that connects the body member to the head member and allows the repositioning of the head member with respect to the body member. These components, as well as those described below, unless otherwise indicated, are made of hard plastic, metal or any other suitable material of sufficient strength and rigidity.

Figures 5, 6, 7, 8:
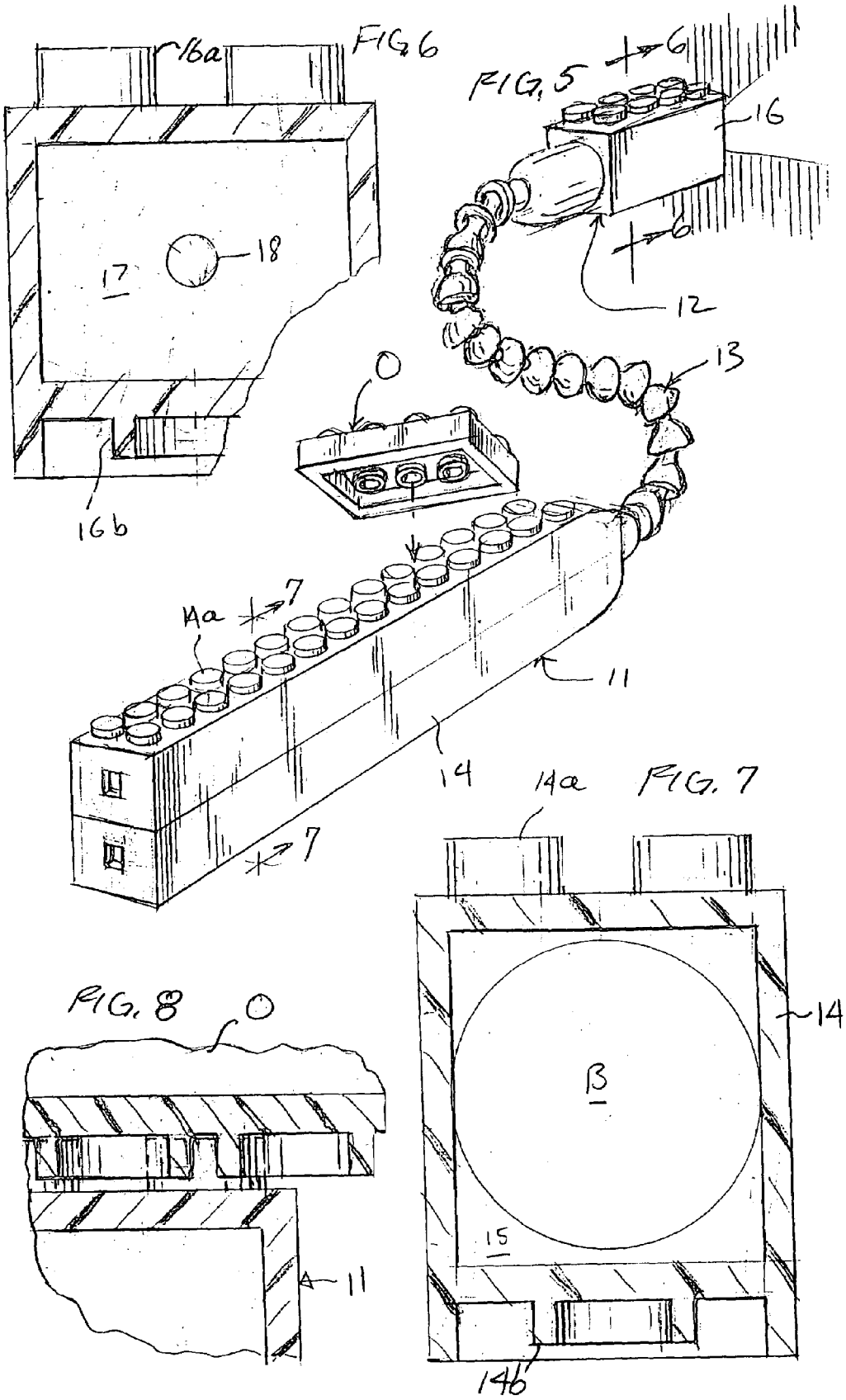
FIG. 5 is another perspective view of the transformable flashlight apparatus of FIG. 1.
FIG. 6 is a sectional view taken along line 6—6 in FIG. 5.
FIG. 7 is a sectional view taken along line 7—7 in FIG. 5.
FIG. 8 is an enlarged and partial sectional view of the connection between the body of the flashlight apparatus and a LEGO™ element detachably secured to it.

The body member 11 includes an elongate housing 14 (See FIGS. 5 and 7) that defines a cavity 15 for containing a power source, such as one or more batteries B. The batteries B provide power for the apparatus as well as additional weight so that the body member can serve as a stable base for the flashlight apparatus. The outer surface of the housing 14 includes a top portion 14*a* and a bottom portion 14*b* having a configuration similar to that of LEGO™ building blocks. These portions define protuberances that nest with corresponding structure on a moveable and detachable object O (See FIGS. 5 and 8), e.g., a LEGO™ building piece. By adding one or more of these objects to the body member 11, one may modify the configuration of the body member 11 and the entire apparatus 10.

Although the flashlight apparatus 10, shown in FIGS. 1–8, employs a LEGO™ type attaching means for releasably securing an object O to the body member 11 and/or to the head member 12, other attaching means may provide the same function. For example, a VELCRO™ connection, an adhesive connection, a connection using magnets a bayonet or telescoping connection as well as other attaching means may serve as adequate substitutes.

Figure 1:
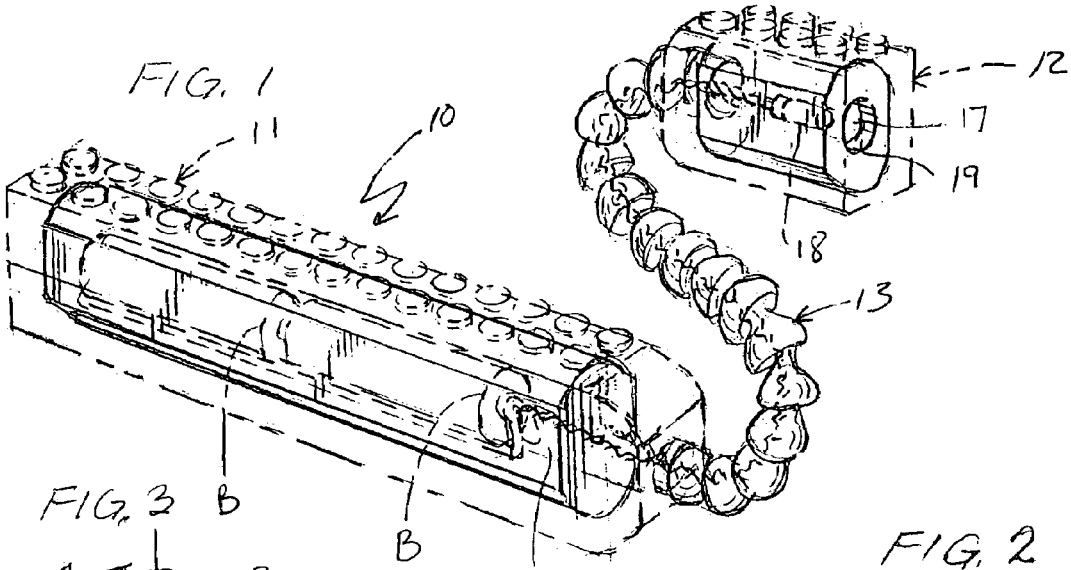
FIG. 1 is a perspective view of the transformable flashlight apparatus of the present invention.
Figure 3:
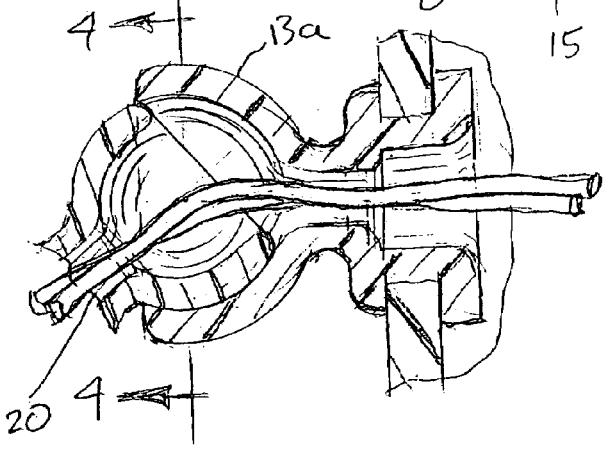
FIG. 3 is a sectional view of the connection between the head and neck portions of the flashlight apparatus of FIG. 1.
Figure 2:
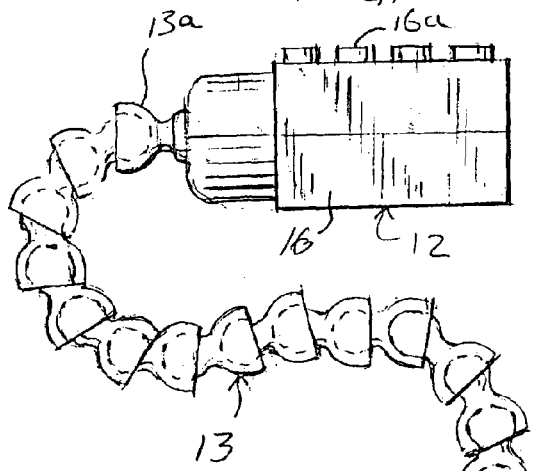
FIG. 2 is a side elevation view of the flashlight apparatus of FIG. 1.
Figure 2:
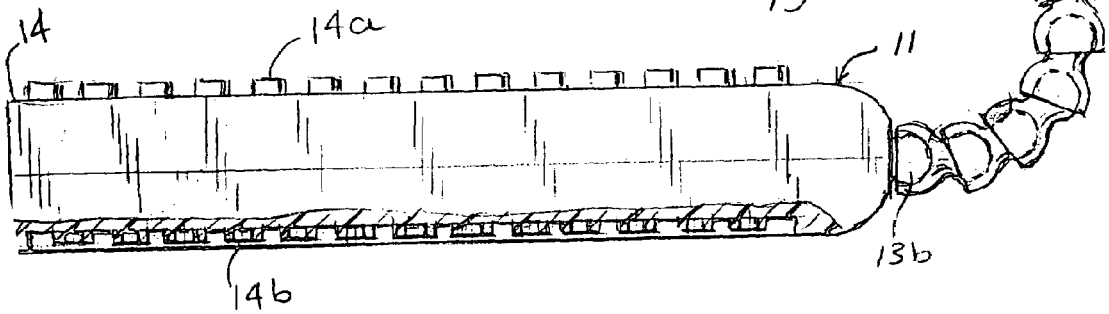
Figure 4:
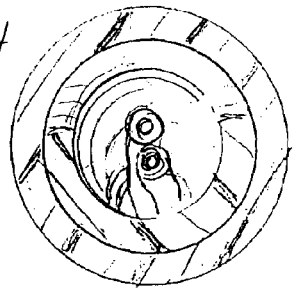
FIG. 4 is a sectional view taken along line 4—4 in FIG. 3.

The head member 12 includes a housing 16 that defines a cavity 17 for containing a light-emitting device 18 such as a bulb, an LED element, or any other such component, and a front opening 19 through which the light from the device 18 passes outwardly of the head member 13. Like the body member 11, the head member 12 includes a top surface portion 16*a* and a bottom surface portion 16*b* which serve as the attaching means for the head member 12. The protuberances and recesses of these surfaces cooperate with corresponding structure of an object O to secure the head member 12 to the object O. (The head member 12 may also employ the alternative attaching means identified above, or any other suitable attaching means.) The connecting member 13 is a predetermined length of ball an socket connectors that define a central passageway 20 for wiring W that connects the batteries B in the body member 11 and the light-emitting device 18 in the head member 12. The connectors have substantially the same shape, except for the end connector 13*a* and 13*b* at opposite ends of the member 13. As shown in FIG. 3, the end connector 13*a* includes a housing-engaging portion which secures the member 13 to the housing 16. The connector 13*b* also includes a similar housing-engaging portion (which the drawings do not show).

FIGS. 9–16 show alternative embodiments of the transformable flashlight of the present invention. The apparatus of FIG. 9 includes two different attaching means for the body member 111. One is a LEGO™ type surface 114*a*, while the other includes two pairs of grooves 114*c* which cooperate with a corresponding set of four ribs R of a wagon O. The wagon is one of the moveable and attachable objects O that attaches to the body member 111. The other type of object that may attach to the body member 111 is a LEGO™ building block.

The embodiment shown in FIG. 9 also includes another type of attaching means for the head member 112. This member 112 includes a smooth and round outer surface 116*c* which cooperates in a telescoping manner with a similarly shaped cavity in another object O, shown in phantom. This object O comprises the head of the toy giraffe having transparent eye portions for the light of the light-emitting device 118 to pass. (A further difference in this embodiment is the connecting member which includes a flexible sleeve 113*c* to cover the ball and socket conduit.

The third embodiment of FIG. 10 includes a head member similar to the one of the embodiment shown in FIG. 9. In this apparatus, the head member 212 contains a power source, e.g., a small battery, as well as a light-emitting device; and the moveable and attachable object is a toy animal's head and a key that lies releaseably secured to the head member with a ring.

Figure 11:
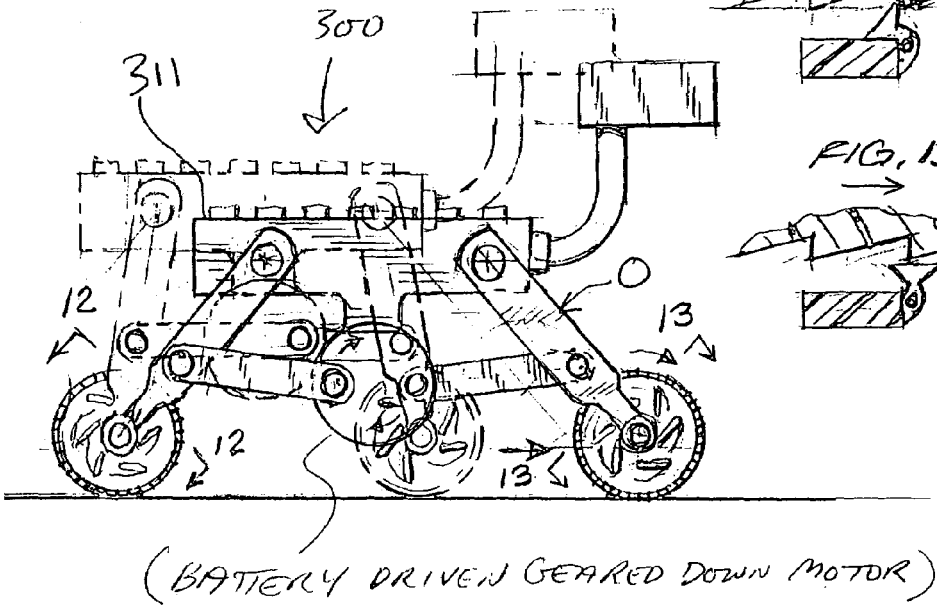
FIG. 11 is a perspective view of a fourth embodiment of the transformable flashlight of the present invention.
Figure 12:
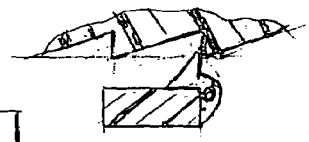
FIG. 12 is a sectional view taken along line 12—12 in FIG. 11.
Figure 13:
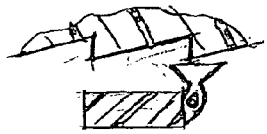
FIG. 13 is a sectional view taken along line 13—13 in FIG. 11.

In the fourth embodiment, shown in FIGS. 11–13, the apparatus of the present invention 300 includes a body member 311 which contains a motor in addition to a power source. Here, the moveable and attachable object O is a wheel and chassis assembly; the attaching means for this assembly is a set of pivot pins; and the connecting member or neck is made of bendable material such as wrapped copper wire.

Figure 14:
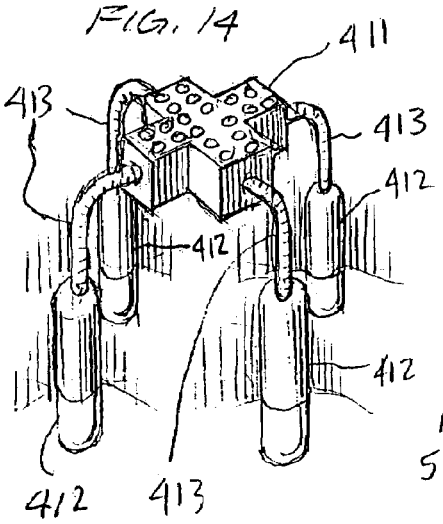
FIG. 14 is a perspective view of a fifth embodiment of the transformable flashlight of the present invention.
Figure 15:
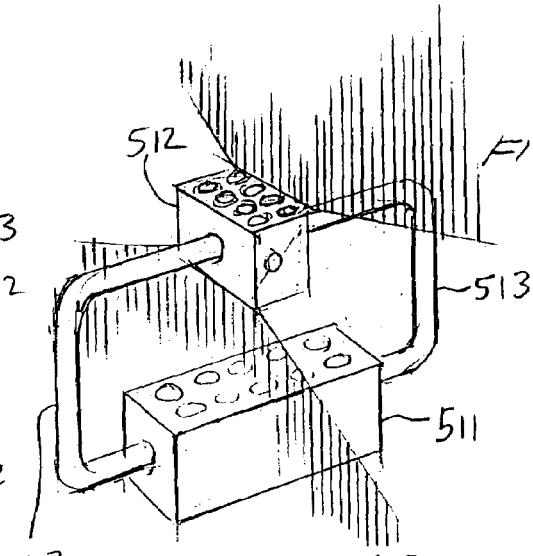
FIG. 15 is a perspective view of a sixth embodiment of the transformable flashlight of the present invention.
Figure 16:
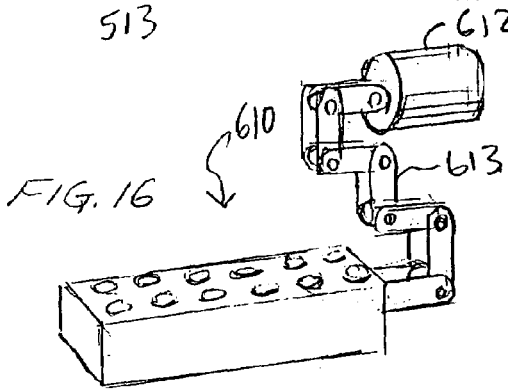
FIG. 16 is a perspective view of a seventh embodiment of the transformable flashlight of the present invention.

The fifth embodiment of FIG. 14 has a body member 411 that comprises a LEGO™ building block, four connecting member 413, and four head members 412. The head members 412 contain both a light-emitting device and a power source; and the connecting members are similar to the connecting member of FIG. 11. The sixth embodiment of FIG. 15 includes a LEGO™ building block body member 511 and head member 512. It includes two connecting members 513; and it houses the light-emitting device and the power source in the head member 512. The seventh embodiment 610 (See FIG. 16) also houses the power source and the light-emitting device in the head member 612. It includes a connecting member 613 comprising a chain-like assembly. The attaching means in the fifth, sixth and seventh embodiments is the irregular LEGO™ surface described more fully with respect to the first embodiment.

While the above description and the drawings disclose and illustrate a number of embodiments, one should understand, of course, that the invention is not limited to those embodiments. Those skilled in the art to which the invention pertains may make other modifications and other embodiments employing the principles of this invention, particularly upon considering the foregoing teachings. Therefore, by the appended claims, the applicant intends to cover any modifications and other embodiments that incorporate those features which constitute the essential features of this invention.

What is claimed is:

1. A flashlight apparatus comprising:

a body member;

a head member including light-emitting means;

a connecting member for connecting the head member to the body member; and attaching means for connecting an attachable and moveable object to the body member and integrating the object with the body member.

2. A flashlight apparatus comprising:

a body member;

a head member including light-emitting means;

a connecting member for connecting the head member to the body member; and a moveable object detachably securable to either the body member or the head member, wherein the moveable object and either the body member or the head member include co-operating means for releaseably securing the object to either the body member or the head member, and wherein the co-operating means includes irregular surfaces on the moveable object and on either the body member or the head member, the irregular surfaces engaging each other to connect the moveable object to either the body member or the head member.

3. The flashlight apparatus of claim 2, wherein the co-operating means connects the object to the body member.

* * * * *